US006986731B2

(12) United States Patent
Fondin et al.

(10) Patent No.: US 6,986,731 B2
(45) Date of Patent: Jan. 17, 2006

(54) ROTOR WITH IRREGULARLY POSITIONED SEATS

(75) Inventors: Jean-Louis Fondin, Saint Nazaire (FR); Jérôme Beaucour, Nantes (FR); Serge Papin, Treillieres (FR)

(73) Assignee: Jouan, Saint-Herblain (FR)

( * ) Notice: Subject to any disclaimer, the term of this patent is extended or adjusted under 35 U.S.C. 154(b) by 122 days.

(21) Appl. No.: 10/338,710

(22) Filed: Jan. 9, 2003

(65) Prior Publication Data

US 2003/0158026 A1 Aug. 21, 2003

(30) Foreign Application Priority Data

Jan. 9, 2002 (FR) ..... 02 00219

(51) Int. Cl.
*B04B 5/02* (2006.01)

(52) U.S. Cl. ..... 494/16

(58) Field of Classification Search ..... 494/12, 494/16, 20, 31, 33, 60; 422/72
See application file for complete search history.

(56) References Cited

U.S. PATENT DOCUMENTS

| | | | | |
|---|---|---|---|---|
| 3,339,836 | A * | 9/1967 | Mitchell et al. | 494/16 |
| 4,553,955 | A | 11/1985 | Lam et al. | |
| 4,820,257 | A * | 4/1989 | Ishimaru | 494/16 |
| 5,605,529 | A | 2/1997 | Petithory | |
| 6,045,494 | A * | 4/2000 | Toyama | |

FOREIGN PATENT DOCUMENTS

| | | | |
|---|---|---|---|
| DE | 3341323 A1 | * | 5/1985 |
| JP | 5-138072 | * | 6/1993 |
| JP | 8-103689 | * | 4/1996 |
| JP | 9-262503 | | 10/1997 |
| JP | 10-328582 | * | 12/1998 |
| JP | 2000-79355 | * | 3/2000 |

* cited by examiner

*Primary Examiner*—Charles E. Cooley
(74) *Attorney, Agent, or Firm*—Young & Thompson

(57) ABSTRACT

A rotor to be driven in rotation about a central axis of rotation (A) is provided with a number n of seats for receiving a product to be centrifuged, the seats being arranged eccentrically relative to the axis of rotation. The geometric image (I) of at least a first seat, through a geometric rotation about the central axis of rotation (A) in a first direction of rotation and an angle of 360°/n, is different from a second seat which directly follows the first seat in the first direction of rotation.

16 Claims, 4 Drawing Sheets

ROTOR WITH IRREGULARLY POSITIONED SEATS

TECHNICAL FIELD

The present invention concerns a rotor of the type intended to be driven in rotation about a central axis of rotation and wherein a number n of seats for receiving a product to be centrifuged are provided, the seats being arranged eccentrically relative to the axis of rotation.

BACKGROUND OF THE INVENTION

The invention applies, for example, to the centrifuging of biological products.

For the centrifuging of such products, rotors of frustoconical shape are generally used in which the seats have been provided in the form of recesses. These seats are elongate in shape and, for each rotor, are regularly distributed about its axis of rotation. The seats are intended to receive, for example, tubes containing the products to be centrifuged and closed by means of stoppers.

A centrifuge using such a rotor generally comprises a trough, equipped with cooling means and in which the rotor is mounted on a rotational drive head.

In ultra-centrifuges, that is to say, centrifuges driving the rotors at speeds of the order of 20,000 r.p.m., the occurrence of excessive noise nuisance such as whistling has been observed.

It is an aim of the invention to solve this problem by limiting the excessive noise nuisance caused by the driving in rotation of rotors of the aforesaid type.

SUMMARY OF THE INVENTION

To this end, the subject of the invention is a rotor of the aforesaid type, wherein the geometric image of at least a first seat, through a geometric rotation about the axis of rotation in a first direction of rotation and an angle of 360°/n, is different from a second seat which directly follows the first seat in the first direction of rotation.

According to particular embodiments, the rotor may comprise one or more of the following characteristics, taken singly or in all the combinations technically possible:

- the seats are invariant through a geometric rotation about the axis of rotation and an angle strictly greater than 360°/n,
- n is an even number greater than or equal to 4 and the seats are symmetrical in pairs relative to the axis of rotation,
- the seats are of a substantially analogous shape, elongate in a respective longitudinal direction and the second seat is substantially the image, through a geometric transformation, of the geometric image of the first seat,
- the geometric transformation comprises a geometric rotation by a non-zero angle in a plane orthogonal to the axis of rotation,
- the geometric transformation comprises a geometric rotation by a non-zero angle in a plane containing the axis of rotation and the longitudinal direction of the geometric image of the first seat,
- the geometric transformation comprises a geometric translation by a non-zero distance in a plane orthogonal to the axis of rotation,
- the geometric transformation comprises a geometric translation by a non-zero distance in a plane containing the axis of rotation and the longitudinal direction of the geometric image of the first seat.

A further subject of the invention is a centrifuge comprising a trough, a rotor intended to be disposed in the trough, and means for driving the rotor in rotation, characterised in that the rotor is a rotor as defined above.

BRIEF DESCRIPTION OF DRAWING

The invention will be more clearly understood on reading the following description, provided solely by way of example and with reference to the appended drawings, in which.

DESCRIPTION OF PREFERRED EMBODIMENT

Figure 1:
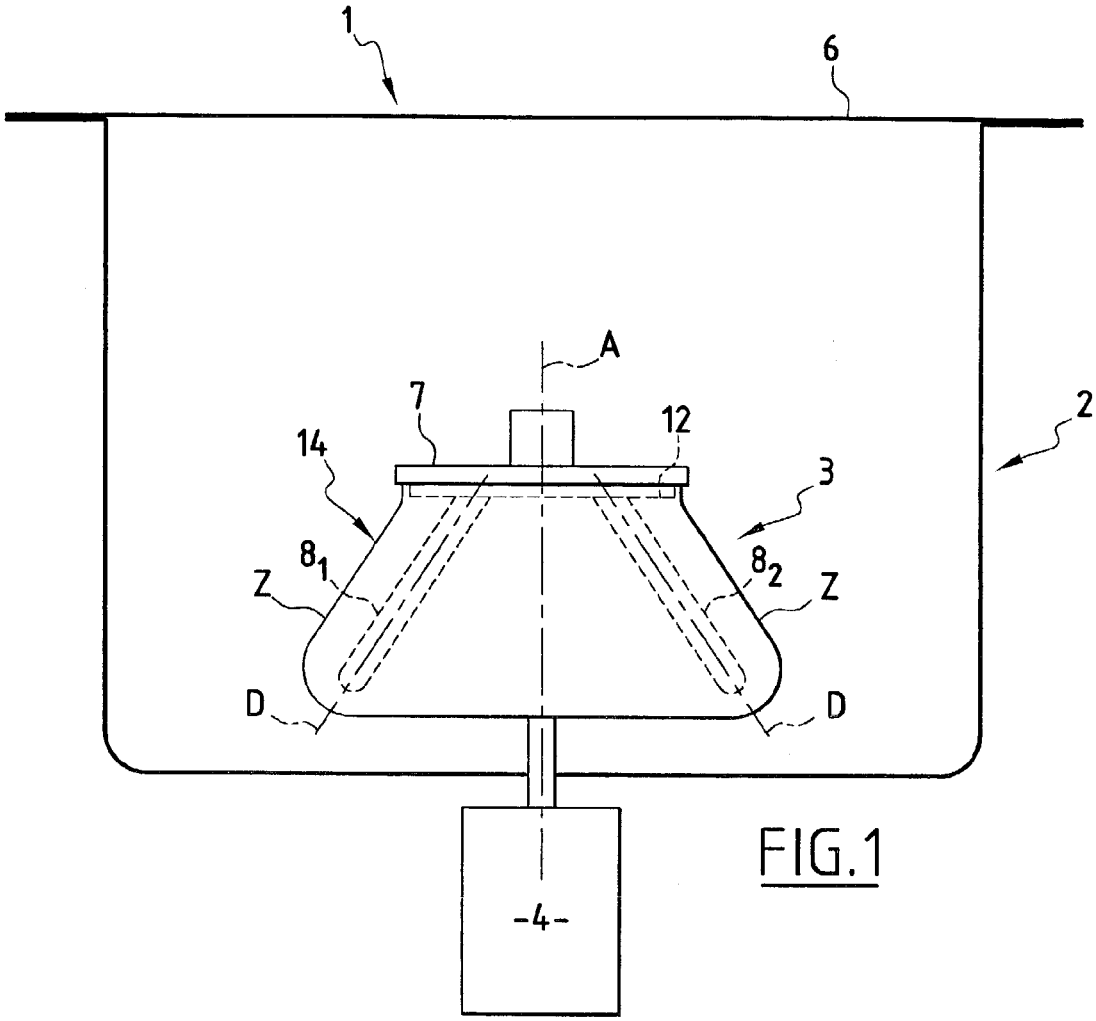
FIG. 1 is a diagrammatic side view of a centrifuge according to the invention.
Figure 2:
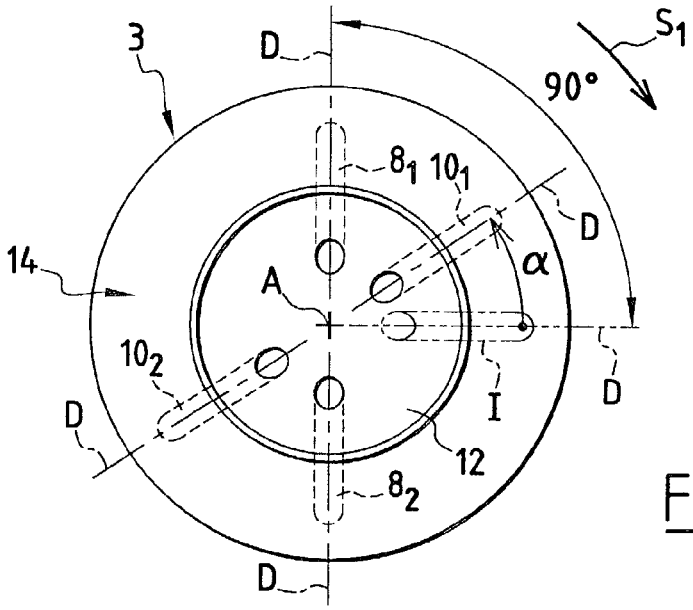
FIG. 2 is a diagrammatic view from above of the rotor of FIG. 1, FIGS. 3 and 4 are views analogous to FIG. 2, respectively illustrating a second and a third embodiment of the rotor.

FIGS. 1 and 2 illustrate diagrammatically a centrifuge 1 which comprises a trough 2, a rotor 3 disposed in the trough 2, and means 4 for driving the rotor 3 in rotation about a substantially vertical axis of rotation A.

In a conventional manner, the trough 2 comprises a movable access door 6 and means for cooling its internal atmosphere, which cooling means are not shown in the drawings.

The rotor 3 is a rotor of generally frustoconical shape with a central axis A. It is equipped with a removable closure lid 7. The lid 7 has not been shown in FIG. 2.

The rotor 3 is for example made from metal and four seats, arranged eccentrically relative to the axis A, are provided therein, that is to say, a first pair of seats $\mathbf{8}_1$ and $\mathbf{8}_2$ and a second pair of seats $\mathbf{10}_1$ and $\mathbf{10}_2$. It will be noted that the seats $\mathbf{10}_1$ and $\mathbf{10}_2$ are not shown in FIG. 1.

The seats $\mathbf{8}_1$ and $\mathbf{8}_2$ of the first pair are symmetrical to each other relative to the axis A. The seats $\mathbf{10}_1$ and $\mathbf{10}_2$ of the second pair are symmetrical to each other relative to the axis A.

The seats $\mathbf{8}_1$, $\mathbf{8}_2$, $\mathbf{10}_1$ and $\mathbf{10}_2$ are of an analogous shape, elongate in a respective longitudinal direction D.

As can be seen in FIG. 1 for the seats $\mathbf{8}_1$ and $\mathbf{8}_2$, each direction D is inclined relative to the axis of rotation A and intersects it at a geometric point located above the rotor 3 and its lid 7.

The seats $\mathbf{8}_1$, $\mathbf{8}_2$, $\mathbf{10}_1$, and $\mathbf{10}_2$ open into the upper surface 12 of the rotor to make it possible, when the lid 7 is withdrawn, to introduce into the seats recipients containing the product(s) to be centrifuged, for example tubes closed by means of stoppers.

In FIG. 1, the distance separating the seats $\mathbf{8}_1$, $\mathbf{8}_2$, $\mathbf{10}_1$ and $\mathbf{10}_2$ from the outer lateral surface 14 of the rotor 3 has been exaggerated to facilitate illustration.

As can be seen in FIG. 2, the distribution of the seats $\mathbf{8}_1$, $\mathbf{8}_2$, $\mathbf{10}_1$ and $\mathbf{10}_2$ about the axis of rotation A is irregular.

If such distribution were regular, the rotor 3 would be invariant through a geometric rotation of axis A and angle equal to 90° (π/2 rad). Thus, the geometric image I (double-dash/dotted line) of the seat $\mathbf{8}_1$ through such a rotation in a first direction $S_1$ would coincide with the seat $\mathbf{10}_1$, which seat directly follows the seat $\mathbf{8}_1$ in that direction $S_1$.

In the rotor of FIGS. 1 and 2, the seat $\mathbf{10}_1$ does not coincide with this image I but, in a view from above, is offset angularly from the image I by a non-zero angle α centred on the axis A and negative with respect to the direction $S_1$.

In other words, the seat $\mathbf{10}_1$ is the image, through a geometric rotation of axis A and angle α, of the image I.

Thus, the longitudinal directions D of the seats $\mathbf{10}_1$ and of the image I form, in a view from above, an angle α centred on the axis A and negative when considering the direction $S_1$.

The angle α is, for example, 4° and may more generally be between 2° and 10°.

It will be noted that in FIG. 2, the amplitude of the angle α has been exaggerated in order to facilitate illustration.

Similarly, the seat $\mathbf{10}_2$ is offset angularly, in a view from above, from the image, not shown, of the seat $\mathbf{8}_2$ through the aforesaid rotation.

Thus, the seats $\mathbf{8}_1$, $\mathbf{8}_2$, $\mathbf{10}_1$ and $\mathbf{10}_2$ are invariant through a geometric rotation of axis A and angle equal to 180° (π rad) but not through a rotation of axis A and angle equal to 90° (π rad) as in the state of the art.

It was found, when driving the rotor 3 in rotation at relatively high speeds, typically above 10,000 r.p.m., that the excessive noise nuisances such as whistling are severely reduced, or even eliminated.

It is considered at present that the reason for this reduction or elimination of excessive noise nuisance may be as follows. When the rotor 3 is driven in rotation, the areas Z (FIG. 1) of the outer lateral surface 14 of the rotor 3 which are located radially opposite the seats $\mathbf{8}_1$, $\mathbf{8}_2$, $\mathbf{10}_1$ and $\mathbf{10}_2$ deform, under the action of centrifugal force, radially outwards more severely than the areas of the outer lateral surface 14 that are located between the seats. The reliefs thus created on the surface 14 are, like the seats $\mathbf{8}_1$, $\mathbf{8}_2$, $\mathbf{10}_1$ and $\mathbf{10}_2$, invariant through a geometric rotation of axis A and angle equal to 180° (π rad), and not through a geometric rotation of axis A and angle equal to 90° as in the state of the art. Thus, the frequencies and the intensities of the acoustic waves produced during the driving in rotation of the rotor are modified and the excessive noise nuisances are reduced, or even eliminated.

Moreover, the imbalances caused by the irregularity of arrangement of the seats are relatively small and acceptable owing to the fact that α is relatively small.

According to a variant of the embodiment of FIGS. 1 and 2, the angle α may be positive with respect to the direction $S_1$.

More generally, other arrangements of the seats $\mathbf{8}_1$, $\mathbf{8}_2$, $\mathbf{10}_1$ and $\mathbf{10}_2$ may be envisaged.

Figure 3:
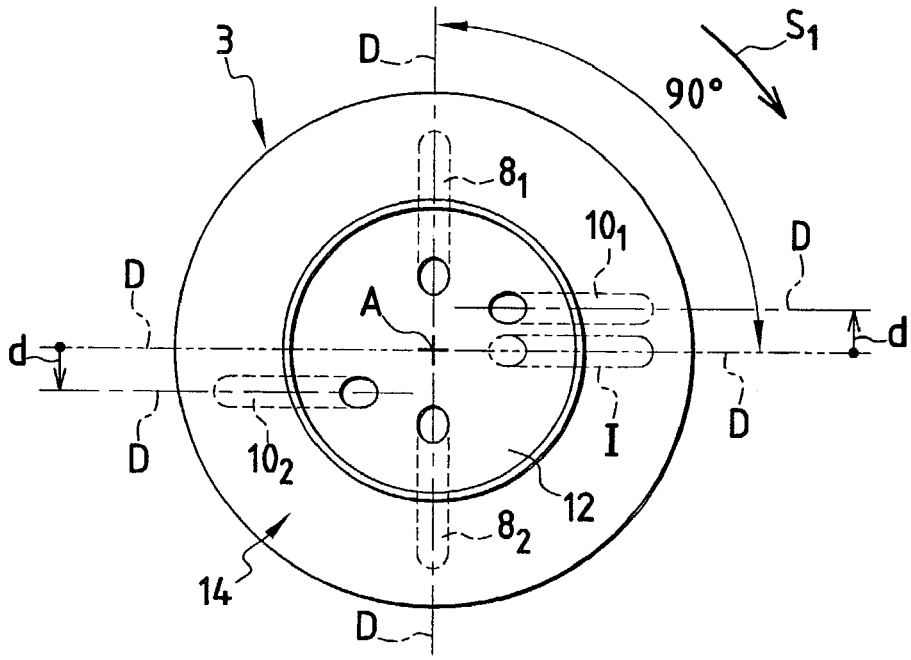

Thus, in the embodiment of FIG. 3, the seat $\mathbf{10}_1$, in a view from above, is laterally translated, relative to the image I of the seat $\mathbf{8}_1$, in the opposite direction from the direction $S_1$, by a non-zero distance d. Thus the longitudinal directions D of the seat $\mathbf{10}_1$ and of the image I of the seat $\mathbf{8}_1$are substantially parallel and spaced laterally from one another.

The distance d is for example 2 mm and may more generally be between 1 and 5 mm.

It will be noted that in FIG. 3 the distance d has been exaggerated.

Since this distance is relatively short, the difference between the centrifuging forces to which the products received in the seats $\mathbf{8}_1$, $\mathbf{8}_2$, $\mathbf{10}_1$ and $\mathbf{10}_2$ will be subjected will remain sufficiently small and acceptable for the homogeneity of the centrifuging treatment. Similarly, the imbalances caused by the irregularity of arrangement remain acceptable.

According to a variant not shown, the seat $\mathbf{10}_1$, in a view from above, may be offset laterally from the image I of the seat $\mathbf{8}_1$ in the direction $S_1$.

More generally, the seat $\mathbf{10}_1$, in a view from above, may be the issue of a geometric translation of the image I, the direction of this translation being not necessarily orthogonal to the direction D of the image I.

Still more generally, the seat $\mathbf{10}_1$ may be deduced from the image I of the seat $\mathbf{8}_1$ through a geometric transformation in a radial plane containing the axis of rotation A and the longitudinal direction D of the image I.

Figure 4:
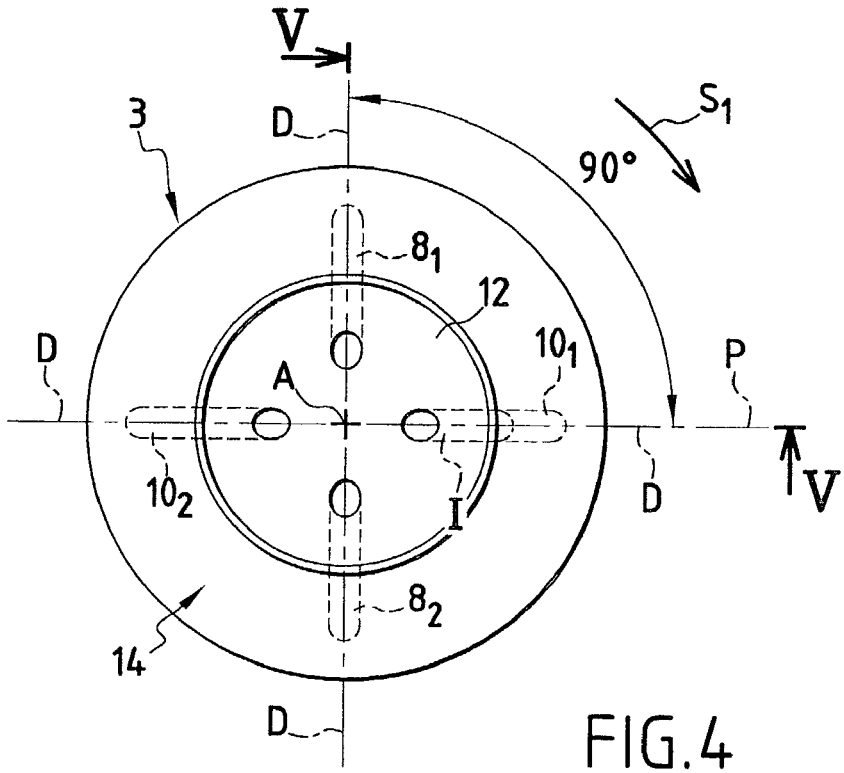
Figure 5:
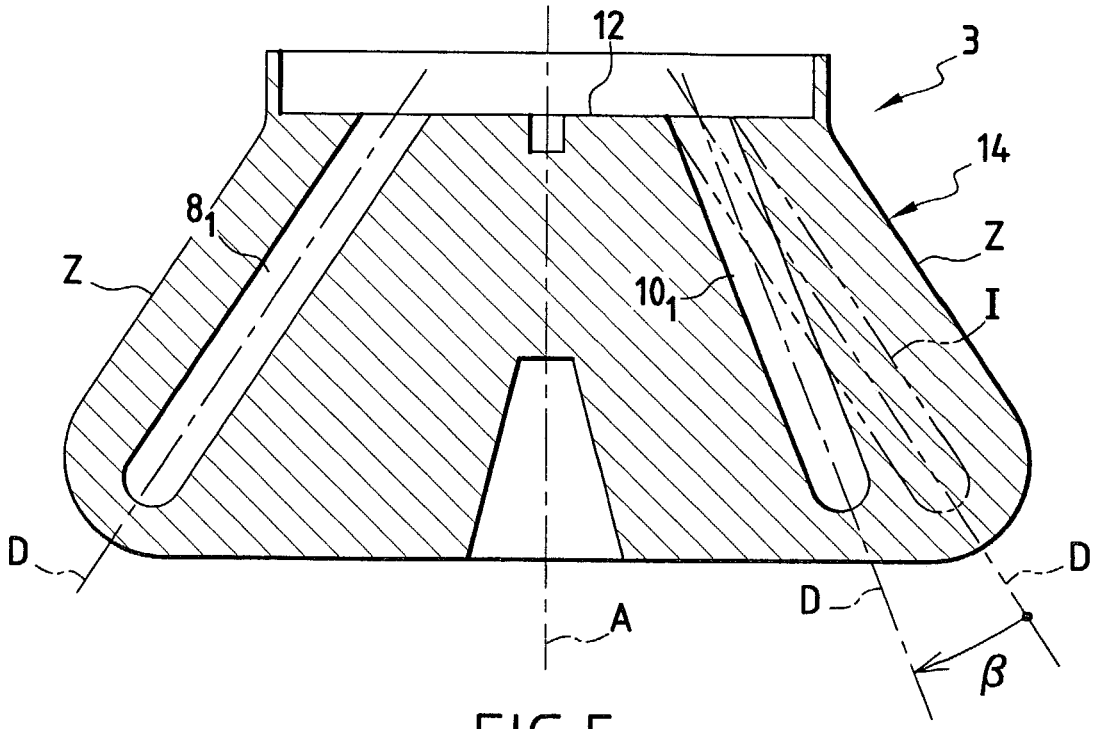
FIG. 5 is a diagrammatic enlarged sectional view of the rotor of FIG. 4, along the broken line V—V.

Thus, FIGS. 4 and 5 illustrate a third embodiment wherein the longitudinal direction D of the seat $\mathbf{10}_1$ is offset angularly by a non-zero angle β relative to the longitudinal direction D of the image I in the aforesaid plane P (FIG. 4). The plane P also contains the direction D of the seat $\mathbf{10}_1$ and corresponds to the right-hand half-plane of FIG. 5. Thus, the seat $\mathbf{10}_1$ is the image, through a geometric rotation of angle β in the plane P, of the image I.

It will be noted that the angle β may be positive or negative. The angle β has for example a value of 4° and may more generally be between 2° and 10°.

Figure 6:
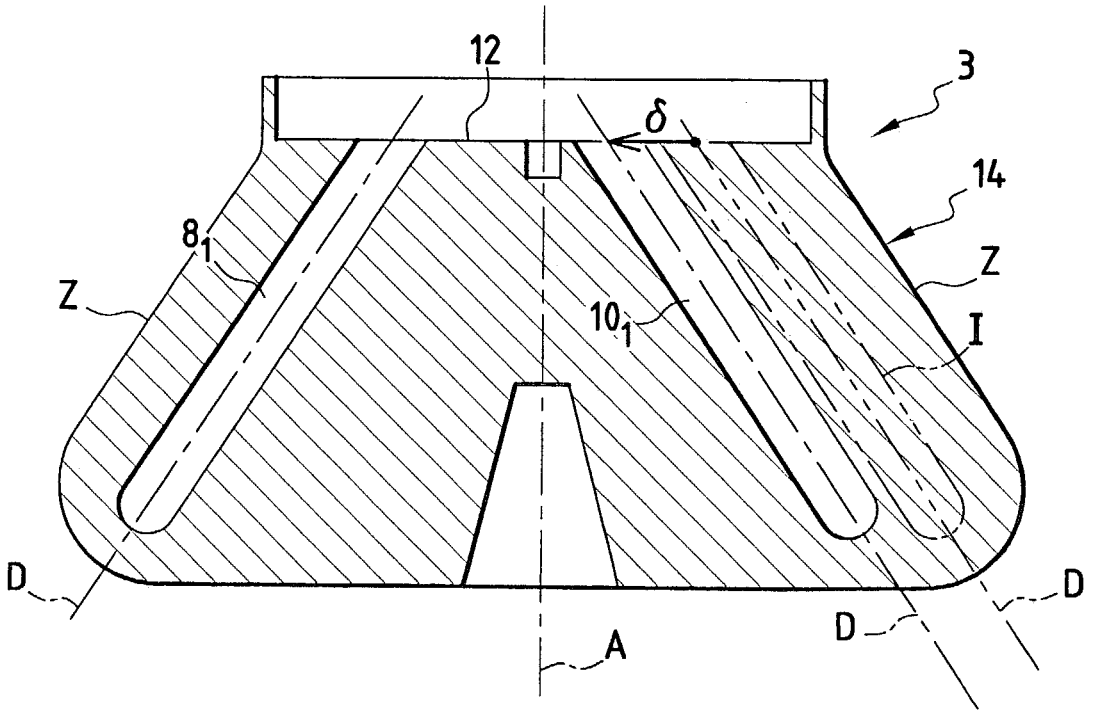
FIG. 6 is a view analogous to FIG. 5, illustrating a fourth embodiment of the rotor.

FIG. 6 illustrates another embodiment wherein the seat $\mathbf{10}_1$ is obtained from the image I through geometric translation by a substantially constant non-zero distance δ in the radial plane P. Thus the directions D of the seat $\mathbf{10}_1$ and of the image I are substantially parallel and spaced from one another. The aforesaid translation may be such that the seat $\mathbf{10}_1$ is closer to or further from the outer lateral surface 14 than the image I.

It will be noted that in FIGS. 5 and 6 the angle β and the distance δ have been exaggerated.

It will also be noted that the angle β or the distance δ are small enough on the one hand for the homogeneity of the centrifuging treatment undergone by products received in the seats $\mathbf{8}_1$, $\mathbf{8}_2$, $\mathbf{10}_1$ and $\mathbf{10}_2$ to be satisfactory and on the other hand for the imbalances to be reduced.

More generally, the above principles may be applied to rotors comprising any number of seats.

They may also be combined with one another for the same seat.

Figure 7:
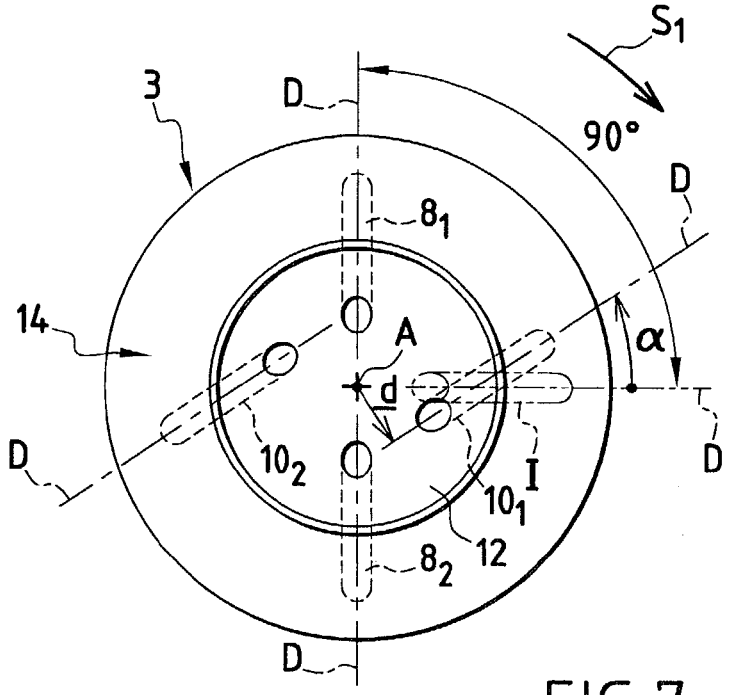
FIG. 7 is a view analogous to FIG. 2, illustrating a fifth embodiment of the rotor.

Thus, FIG. 7 illustrates yet another embodiment wherein the seat $\mathbf{10}_1$ is the image, through a geometric transformation, of the image I, the geometric transformation comprising a geometric rotation and a geometric translation in the plane of FIG. 7 which is orthogonal to the axis of rotation A.

More precisely, the rotation is a rotation of axis A and angle α.

The translation is a translation in the plane of FIG. 7 by a non-zero distance d in a direction which is not orthogonal to the direction D of the image I.

The combination of a rotation and a translation within the geometric transformation allows the seat $\mathbf{10}_1$ to remain close enough to the image I to limit the differences between the centrifuging force undergone by a product contained in the seat $\mathbf{10}_1$ and the centrifuging force of a product received in the seat $\mathbf{8}_1$.

Thus, the homogeneity of the centrifuging treatment undergone by products received in the seats $\mathbf{8}_1$, $\mathbf{8}_2$, $\mathbf{10}_1$ and $\mathbf{10}_2$ is increased. Moreover, this combination makes it possible to reduce the imbalances and also the difference in appearance between a rotor incorporating the principles of the invention and a conventional rotor.

Figure 8:
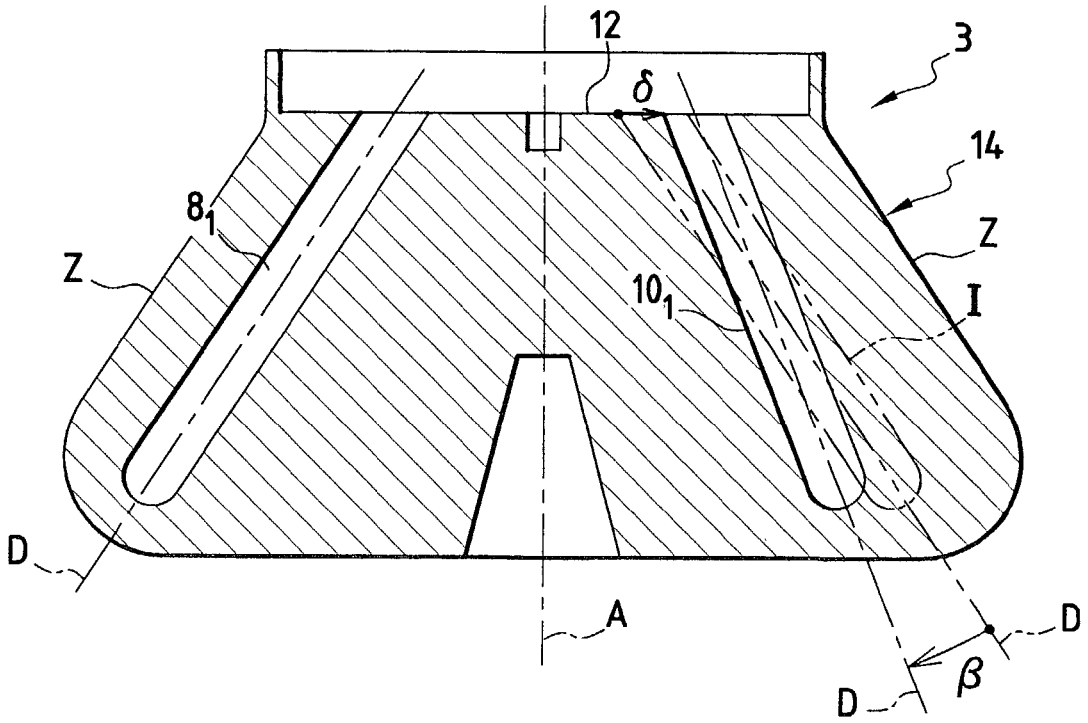
FIG. 8 is a view analogous to FIG. 5, illustrating a sixth embodiment of the rotor.

Similarly, FIG. 8 illustrates another embodiment wherein the seat $\mathbf{10}_1$ is obtained from the image I by a geometric transformation comprising a geometric rotation and a geometric translation in the radial plane P which comprises the axis of rotation A and the longitudinal direction D of the image I.

More precisely, the rotation is a rotation of non-zero angle β and the translation is a translation by a non-zero distance δ in a direction orthogonal to the axis of rotation A.

Here again, the combination of a translation and a rotation makes it possible to increase the homogeneity of the centrifuging treatment undergone by products received in the seats $\mathbf{8}_1$, $\mathbf{8}_2$, $\mathbf{10}_1$ and $\mathbf{10}_2$, to limit the imbalances and to reduce the aesthetic problems.

More generally, the geometric transformation between the image I and the seat $\mathbf{10}_1$ may comprise a translation and/or a rotation in a plane orthogonal to the axis of rotation A, and a translation and/or a rotation in a radial plane containing the axis A.

Generally, also, the translations and rotations described previously may be applied, for example each separately to a respective pair of seats when the number of seats is even and strictly greater than 4.

Preferably, the seats are symmetrical in pairs relative to the axis A. Thus, when the rotor 3 is equipped with an even number n of seats, the rotor 3 will be invariant through a geometric rotation of axis A and angle 180°, thereby making it possible to limit the imbalances. More generally, an invariance through a geometric rotation of axis A and angle strictly greater than 360°/n will make it possible to limit the imbalances.

In order to avoid the occurrence of excessive noise nuisance, there will still be at least a first seat, the geometric image of which, through a geometric rotation about the axis of rotation A and an angle 360°/n in one direction of rotation, is different from a second seat of the rotor, the second seat directly following the first seat in the selected direction of rotation.

What is claimed is:

1. A rotor (3) intended to be driven in rotation about a central axis of rotation (A), comprising:

a number n of seats ($\mathbf{8}_1$, $\mathbf{8}_2$, $\mathbf{10}_1$ and $\mathbf{10}_2$) for receiving a product to be centrifuged, the seats being arranged eccentrically relative to the axis of rotation, the seats ($\mathbf{8}_1$, $\mathbf{8}_2$, $\mathbf{10}_1$, $\mathbf{10}_2$) being of a substantially analogous shape, elongate in a respective longitudinal direction (D), wherein the geometric image (I) of at least a first seat ($\mathbf{8}_1$), through a geometric rotation about the axis of rotation (A) in a first direction of rotation ($S_1$) and through an angle of 360°/n, is different from a second seat ($\mathbf{10}_1$) which directly follows the first seat ($\mathbf{8}_1$) in the first direction of rotation ($S_1$), and wherein the second seat is substantially the image, through a geometric transformation, of the geometric image (I) of the first seat ($\mathbf{8}_1$), said geometric transformation comprising at least one of i) a geometric rotation by a non-zero angle (α) in a plane orthogonal to the axis of rotation (A) and ii) a geometric translation by a non-zero distance (d) in a plane orthogonal to the axis of rotation (A), the direction of the translation being inclined with respect to the longitudinal direction (D) of the geometric image (I) of the first seat.

2. A rotor according to claim 1, wherein the seats ($\mathbf{8}_1$, $\mathbf{8}_2$, $\mathbf{10}_1$, $\mathbf{10}_2$) are invariant through a geometric rotation about the axis of rotation and an angle strictly greater than 360°/n.

3. A rotor according to claim 2, wherein n is an even number greater than or equal to 4 and the seats ($\mathbf{8}_1$, $\mathbf{8}_2$, $\mathbf{10}_1$, $\mathbf{10}_2$) are symmetrical in pairs relative to the axis of rotation (A).

4. A rotor according to claim 3, wherein the geometric transformation comprises a geometric rotation by a non-zero angle (β) in a plane containing the axis of rotation (A) and the longitudinal direction of the geometric image (I) of the first seat ($\mathbf{8}_1$).

5. A rotor according to claim 4, wherein the geometric transformation comprises a geometric translation by a non-zero distance (δ) in a plane containing the axis of rotation (A) and the longitudinal direction (D) of the geometric image (I) of the first seat ($\mathbf{8}_1$).

6. A rotor according to claim 3, wherein the geometric transformation comprises a geometric translation by a non-zero distance (δ) in a plane containing the axis of rotation (A) and the longitudinal direction (D) of the geometric image (I) of the first seat ($\mathbf{8}_1$).

7. A rotor according to claim 2, wherein the geometric transformation comprises a geometric rotation by a non-zero angle (β) in a plane containing the axis of rotation (A) and the longitudinal direction of the geometric image (I) of the first seat ($\mathbf{8}_1$).

8. A rotor according to claim 7, wherein the geometric transformation comprises a geometric translation by a non-zero distance (δ) in a plane containing the axis of rotation (A) and the longitudinal direction (D) of the geometric image (I) of the first seat ($\mathbf{8}_1$).

9. A rotor according to claim 2, wherein the geometric transformation comprises a geometric translation by a non-zero distance (δ) in a plane containing the axis of rotation (A) and the longitudinal direction (D) of the geometric image (I) of the first seat ($\mathbf{8}_1$).

10. A rotor according to claim 1, wherein the geometric transformation comprises a geometric rotation by a non-zero angle (β) in a plane containing the axis of rotation (A) and the longitudinal direction of the geometric image (I) of the first seat ($\mathbf{8}_1$).

11. A rotor according to claim 10, wherein the geometric transformation comprises a geometric translation by a non-zero distance (δ) in a plane containing the axis of rotation (A) and the longitudinal direction (D) of the geometric image (I) of the first seat ($\mathbf{8}_1$).

12. A rotor according to claim 1, wherein the geometric transformation comprises a geometric translation by a non-zero distance (δ) in a plane containing the axis of rotation (A) and the longitudinal direction (D) of the geometric image (I) of the first seat ($\mathbf{8}_1$).

13. The rotor of claim 1, wherein the second seat ($\mathbf{10}_1$), after the geometric rotation, is substantially the image, through a geometric transformation, of the geometric image (I) of the first seat ($\mathbf{8}_1$), said geometric transformation comprising at least one of and only i) a geometric rotation by a non-zero angle (α) in a plane orthogonal to the axis of rotation (A) and ii) a geometric translation by a non-zero distance (d) in a plane orthogonal to the axis of rotation (A), the direction of the translation being inclined with respect to the longitudinal direction (D) of the geometric image (I) of the first seat.

14. A rotor (3) intended to be driven in rotation about a central axis of rotation (A), comprising:

plural seats for receiving a product to be centrifuged, including at least a first seat, a second seat, and a third seat, the second seat immediately following the first seat, and the third seat immediately following the second seat, the plural seats being arranged, from a top view, eccentrically relative to the axis of rotation, wherein, from the top view, at least one seat of the first, second, and third seats has a longitudinal axis aligned intersecting with the axis of rotation (A), and another seat of the first, second and third seats has a longitudinal axis in offset alignment, non-intersecting with the axis of rotation (A), the offset alignment being by a non-zero distance (d) in a plane orthogonal to the axis of rotation (A).

15. The rotor of claim 14, wherein, from the top view, the longitudinal axis of the another seat is parallel to a line both passing through the axis of rotation (A) and in the plane orthogonal to the axis of rotation (A).

16. The rotor of claim 14, wherein, from the top view, the longitudinal axis of the another seat intersects a line both passing through the axis of rotation (A) and in the plane orthogonal to the axis of rotation (A).

* * * * *